US012484727B1

(12) United States Patent
Calvanese

(10) Patent No.: US 12,484,727 B1
(45) Date of Patent: Dec. 2, 2025

(54) ADJUSTABLE HANGER FOR USE IN HANGING GARMENTS AND APPAREL

(71) Applicant: Micheal Calvanese, Grand Rapids, MI (US)

(72) Inventor: Micheal Calvanese, Grand Rapids, MI (US)

( * ) Notice: Subject to any disclaimer, the term of this patent is extended or adjusted under 35 U.S.C. 154(b) by 0 days.

(21) Appl. No.: 18/815,722

(22) Filed: Aug. 26, 2024

(51) Int. Cl.
*A47G 25/44* (2006.01)

(52) U.S. Cl.
CPC ..... *A47G 25/441* (2013.01)

(58) Field of Classification Search
CPC .... A47G 25/44; A47G 25/441; A47G 25/442; A47G 25/443
See application file for complete search history.

(56) References Cited

U.S. PATENT DOCUMENTS 2,500,817 A * 3/1950 Glassmeyer ..... A47G 25/442 223/89
2,620,102 A * 12/1952 Bremer ..... A47G 25/442 223/89
3,005,579 A * 10/1961 Thurber ..... A47G 25/442 223/89
5,082,152 A * 1/1992 Chen ..... A47G 25/743 223/89
5,476,199 A * 12/1995 Halverson ..... A47G 25/442 223/89
6,068,166 A * 5/2000 Kilian ..... A47G 25/442 223/89
6,164,504 A * 12/2000 Richard ..... A47G 25/442 223/89
6,637,630 B1 * 10/2003 Rivenburgh ..... A47G 25/442 223/94
D488,309 S * 4/2004 Atwood ..... D6/319
6,722,538 B1 * 4/2004 Autry ..... A47G 25/441 223/89
8,256,650 B2 9/2012 Sokol
2003/0132258 A1 * 7/2003 Viazanko ..... A47G 25/743 223/85
2006/0011672 A1 * 1/2006 Veliuona ..... A47G 25/442 223/85

(Continued)

FOREIGN PATENT DOCUMENTS

GB 2206783 A * 1/1989 ..... A47G 25/442
GB 2262224 A * 6/1993 ..... A47G 25/442

(Continued)

OTHER PUBLICATIONS

Translation KR 20120007480.*

*Primary Examiner* — Shaun R Hurley
(74) *Attorney, Agent, or Firm* — Frank M. Scutch, III

(57) ABSTRACT

An adjustable clothing hanger for use in for hanging garments and apparel includes a flattened triangular shaped body having a first upper rail and second upper rail. A plurality of extension assemblies are used to attach over the first upper rail and second upper rail. The plurality of extension assemblies each include a plurality of engagement members configured within the assembly that allow the respective extension assembly to engage with a corner of the triangular shaped body. This allows the extension assembly to be held into a fixed position and adjusted to a desired length and overall size depending on size and shape of the garment.

14 Claims, 5 Drawing Sheets

(56) References Cited

U.S. PATENT DOCUMENTS

| | | | | |
|---|---|---|---|---|
| 2008/0257920 | A1* | 10/2008 | Spencer | A47G 25/442<br>223/89 |
| 2011/0121041 | A1* | 5/2011 | Tukulj-Popovic | A47G 25/442<br>223/94 |
| 2013/0320051 | A1* | 12/2013 | Madden | A47G 25/442<br>223/85 |
| 2014/0361054 | A1* | 12/2014 | San Nicolas | A47G 25/44<br>223/85 |
| 2018/0325298 | A1* | 11/2018 | Williams | A47G 25/44 |
| 2020/0237130 | A1* | 7/2020 | Varelas | A47G 25/442 |

FOREIGN PATENT DOCUMENTS

| | | | | |
|---|---|---|---|---|
| KR | 20120007480 | U * | 10/2012 | |
| WO | WO-2009062226 | A1 * | 5/2009 | A47G 25/20 |

* cited by examiner

100a

100b

A-A

B-B

C-C

ADJUSTABLE HANGER FOR USE IN HANGING GARMENTS AND APPAREL

FIELD OF THE INVENTION

The present invention relates generally to the hanging of garments and more particularly to an adjustable garment, clothing and apparel hanger.

BACKGROUND

Various forms of coat hangers and/or garment hangers are well known in the art. They are used in a variety of applications for hanging garments either in storage or transport. The hanger often works to help to maintain the garment's appearance by preventing wrinkles. Moreover, garment hangers are often used within a closet and personal wardrobe. Often, various size hangers are needed to display garments in a commercial environment.

A problem often arises when a hanger is either too small or too large for a particular garment. This leads to folding, excessive wrinkling and the garment falling form the hanger. Keeping various size hangers in stock can be expensive and burdensome. Thus, new solutions are needed to provide a single hanger that expands to fit various clothing sizes as needed.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1A:
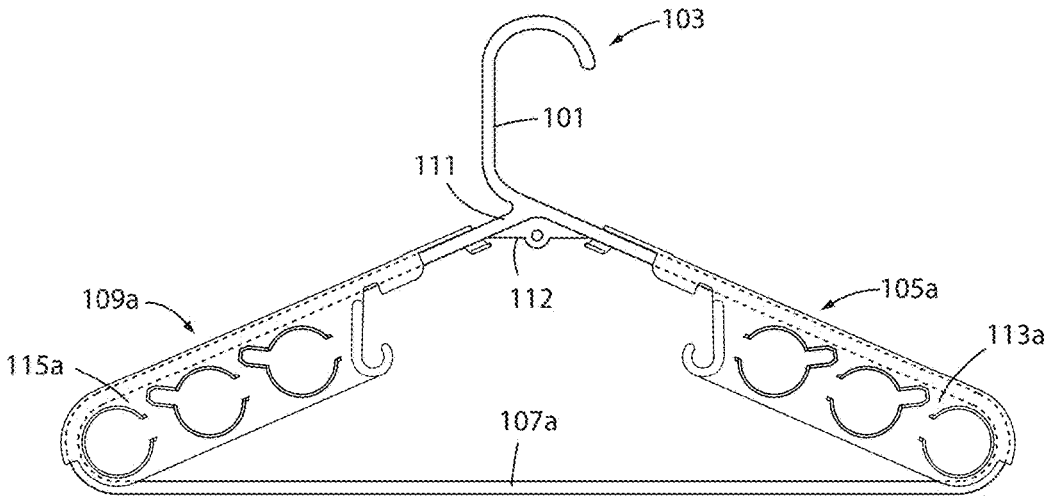
FIG. 1A FIG. 1B and FIG. 1C illustrate various embodiments of the adjustable hanger shown in standard, extended and double extended lengths respectively for accommodating various size garments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an adjustable garment, clothing and apparel hanger. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 1B:
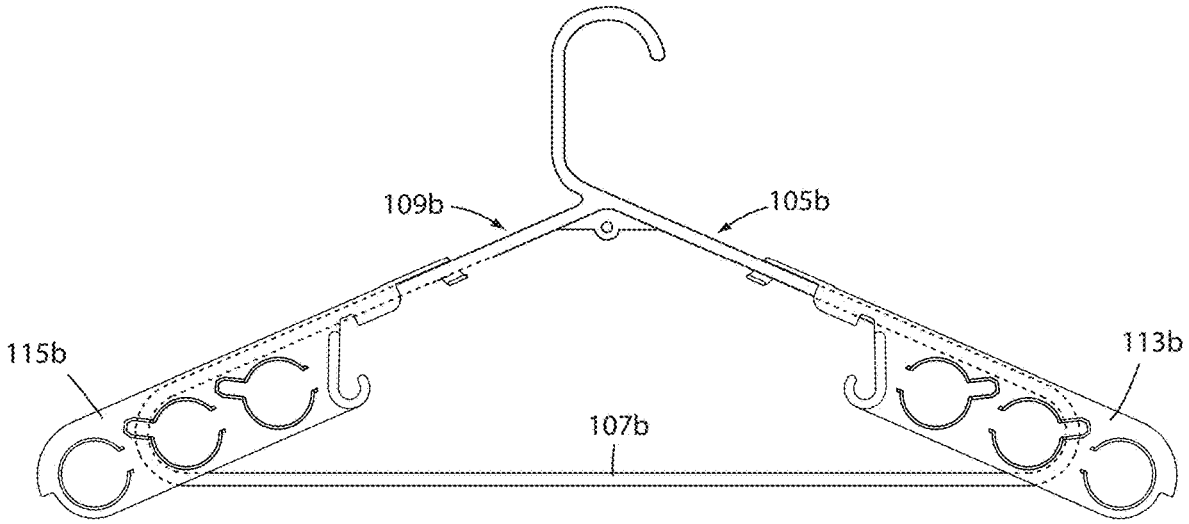
Figure 1C:
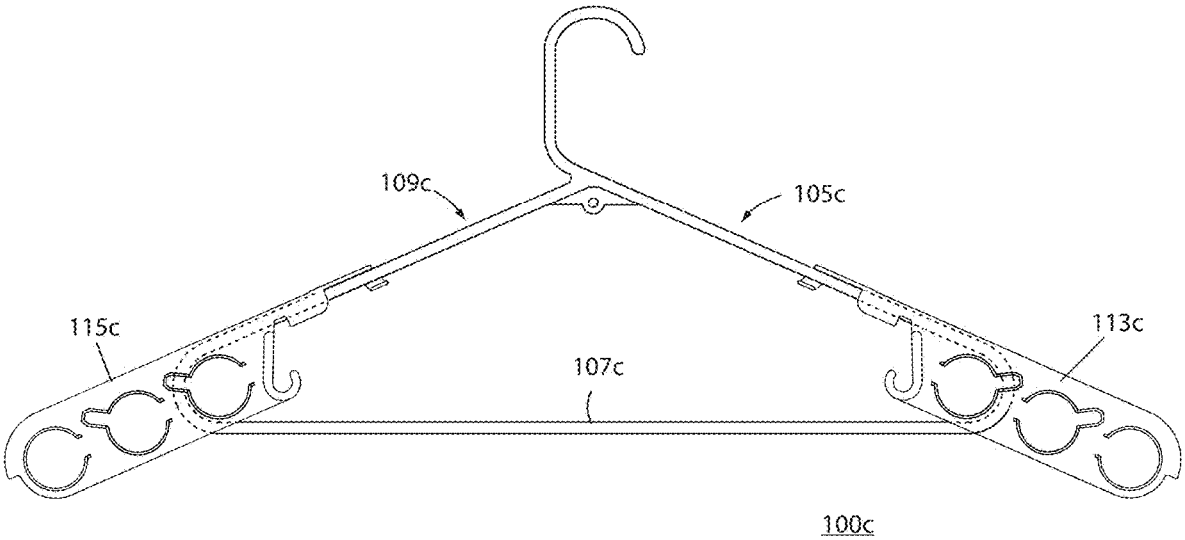
Figure 1D:
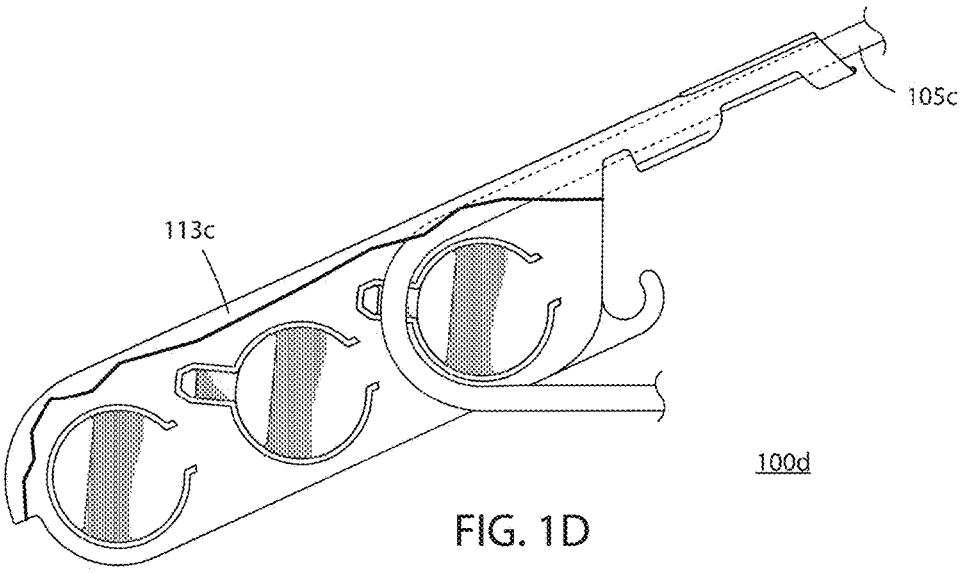
FIG. 1D is a magnified view of the extension assembly shown in FIG. 1C illustrating the position of the extension assembly when in a double extended length.

FIG. 1A FIG. 1B and FIG. 1C illustrate various embodiments of the adjustable hanger shown in standard, extended and double extended lengths respectively as used for accommodating various size garments. Similarly, FIG. 1D is a magnified view of the extension assembly shown in FIG. 1C illustrating the position of the extension assembly when in a double extended length. With regard to FIG. 1A to FIG. 1D, the present invention is directed to an adjustable clothing hanger 100*a*, 100*b*, 100*c*, 100*d*. The hanger includes a main body 101 that is configured into a flat continuous triangular shape formed having a hook 103 at one end, a first top rail 105*a*, 105*b*, 105*c*, a bottom rail 107*a*, 107*b*, 107*c* and second top rail 109*a*, 109*b*, 109*c*. Although the main body 101 is formed using a plastic, round, cylindrical rod-like material, those skilled in the art will recognize that other materials may also be used having different shapes, sizes and durometers. The main body 101 includes rounded bends at its corners such that the main body 101 returns to end 111 just under the hook 103 forming a closed loop. A base 112 can also include a hole configured below the hook 101 enabling a plurality of hangers to be easily joined atop one another with a fastener positioned through the hole for shipping and transport.

Further, the invention further includes a plurality of extension assemblies 113*a*, 115*a* that are used with the hanger enabling it to extend to longer positions. Each of the extension assemblies 113*a*, 115*a* are designed and/or configured to contact and ride upon each of a respective first top rail 105 and second top rail 107. As seen in FIG. 1B, an extended position is shown where the extension assembly 113*b*, 115*b* is positioned further outwardly on its respective rail 105*b*, 109*b*. This enables the hanger assembly to enlarge its supporting area making the hanger 100*a*, 100*b*, 100*c* larger in overall size when in an extended position. Similarly, FIG. 1C shows the extension assemblies 113*c*, 115*c* on their respective rails 105*c*, 109*c* fully extended i.e. in a double extended position. In this way, the hanger 100*c* has the largest supporting area enabling it to support heavy and/or larger sized clothing and garments.

Figure 2A:
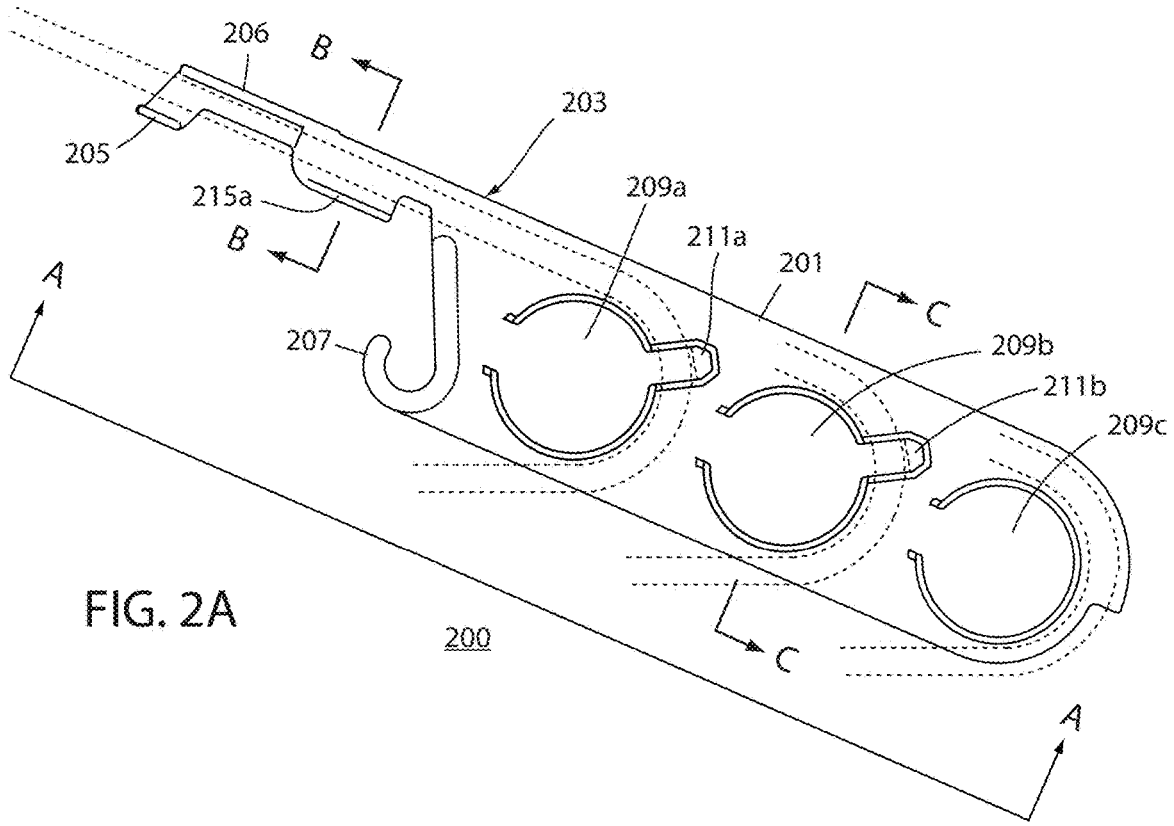
FIG. 2A is a perspective view of the extension assembly shown positioned in its standard, extended and double extended positions.
Figure 2B:
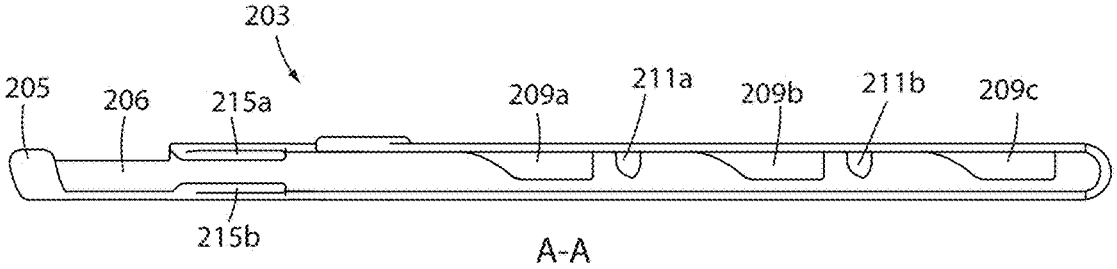
FIG. 2B is a cross-sectional view of the extension assembly shown though lines A-A shown in FIG. 2A.
Figure 2C:
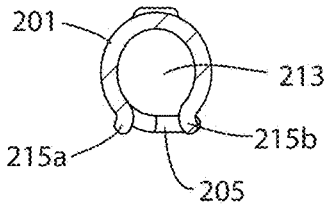
FIG. 2C is a cross-sectional view of the extension assembly shown through lines B-B shown in FIG. 2A.
Figure 2D:
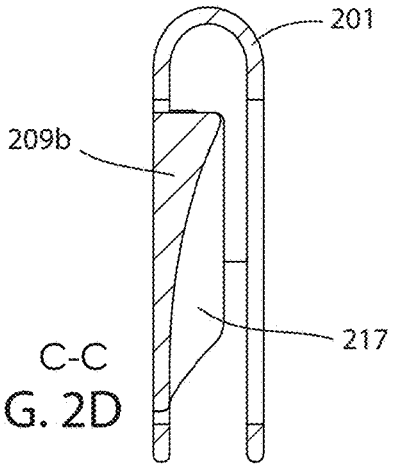
FIG. 2D is a cross-sectional view of the extension assembly shown through lines C-C shown in FIG. 2A.

FIG. 2A is a perspective view of the extension assembly shown positioned in its standard, extended and double extended positions. FIG. 2B is a cross-sectional view of the extension assembly shown though lines A-A shown in FIG. 2A. FIG. 2C is a cross-sectional view of the extension assembly shown through lines B-B shown in FIG. 2A. FIG. 2D is a cross-sectional view of the extension assembly shown through lines C-C shown in FIG. 2A. With regard to FIG. 2A through FIG. 2D, an extension assembly 200 is shown where it includes a substantially U-shaped outer body 201 forming a channel that is configured to be supported by a hanger rail. The U-shaped outer body 201 is configured to orient and/or wrap around each rail using its open end. As described herein, the body 200 is capable of moving in either direction, namely both inwardly and outwardly along the first and second top rail 203 to adjust the required supporting area of the hanger. A looped segment 205 is positioned on the inside edge of the body 201 with a guide area 206 that works to frictionally engage the rail to prevent unintended movement. A J-hook 207 is positioned to extend inwardly toward the center of the hanger. The J-hook 207 allows garments having loops or shoulder straps to be easily hung from the hanger.

Each extension assembly 201 further includes a plurality of round engagement members 209*a*, 209*b*, 209*c*. The engagement members 209*a* and 209*b* include a tab 211*a* and 211*b* that extends over the hanger corner when in a locking position. Each of the engagement members 209*a*, 209*b* and 209*c* are configured in a round, irregular, non-flat shape having one end folded downwardly. As seen in FIG. 2A, each of the engagement members 209*a*, 209*b*, 209*c* are partially attached to the body 201 at their inside edge. Depending on the position of the extension assembly 200, a specific engagement member 209*a*, 209*b*, 209*c* will abut the corner of the hanger, allowing its downwardly facing end to engage within the hanger corner holding itself into a fixed position. Each of the engagement members 209*a*, 209*b*, 209*c* are resilient being attached to the engagement member 209*a*, 209*b*, 209*c* at one spot. Thus, each member can be flexed in relation to the body 201. This allows the engagement members 209*a*, 209*b*, 209*c* to be disengaged from the corner of the main hanger body.

As seen in FIG. 2B and FIG. 2C, the extension assembly is shaped to form a channel or void 213 allowing it to snap over the main body of the hanger. Stubs 215*a*, 215*b* wrap around the main body to hold the extension assembly to the cylindrical main hanger body. With regard to FIG. 2D, the protrusion 217, of the engagement member 209*b*, is illustrated which engages with the hanger corner. When a user desires to move the extension assembly 200 along the first or second top rail, an engagement member is pushed and/or flexed so the extension assembly 200 disengages from the corner where it than can be moved along its rail. As described herein, three hanger sizes are possible, namely a standard size, extended size and double extended size where a respective engagement member 209*a*, 209*b*, 209*c* will be engaged within the hanger corner depending on desired size.

Figure 3A:
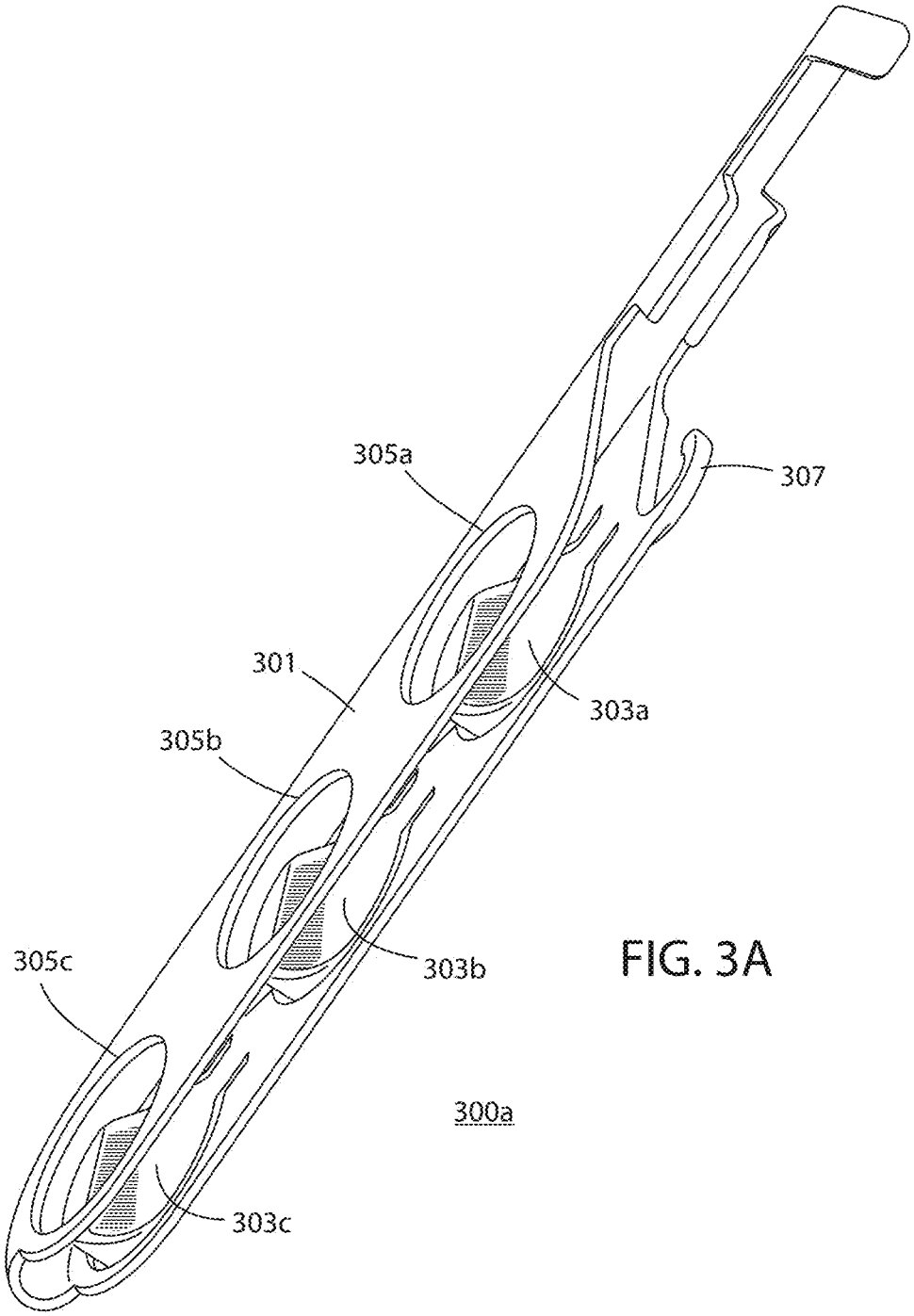
FIG. 3A is a left-side perspective view of the extension assembly.
Figure 3B:
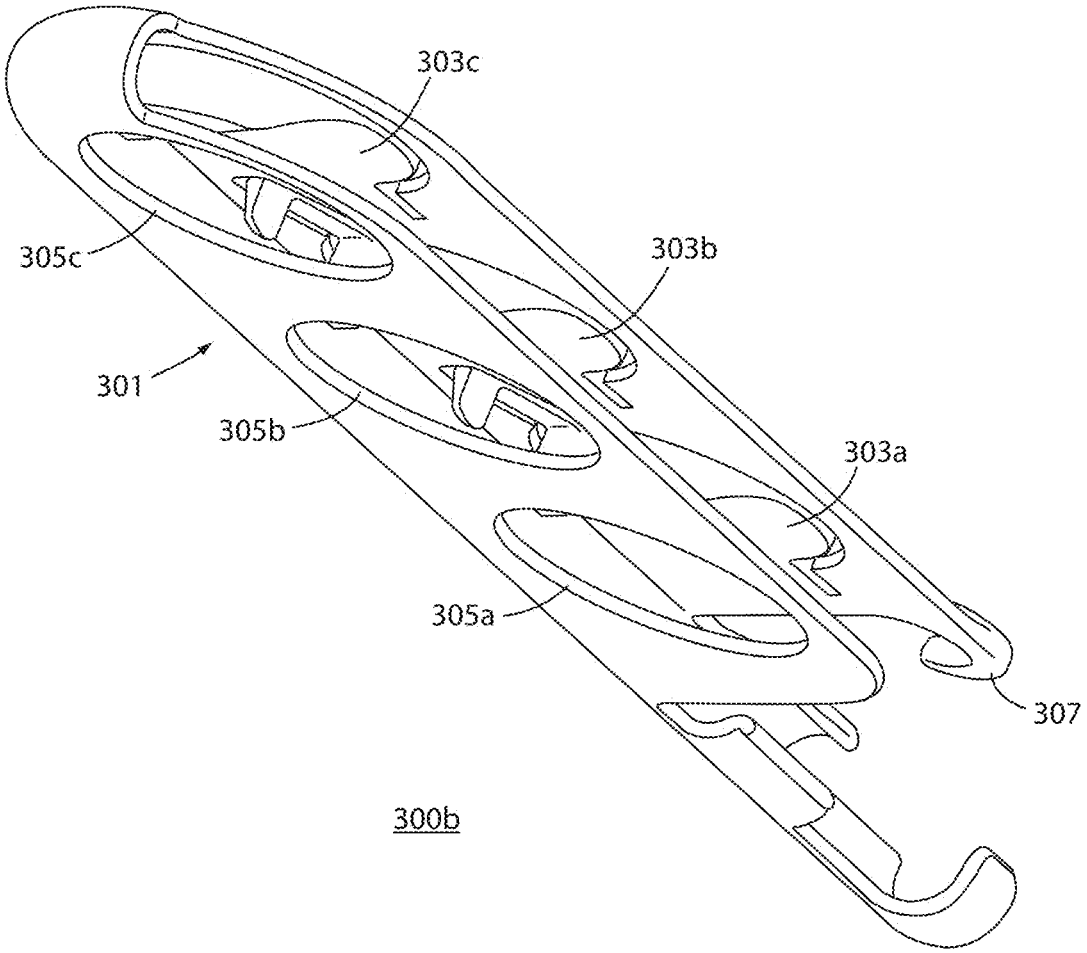
FIG. 3B is a right-side perspective view of the extension assembly.

FIG. 3A illustrates a left-side perspective view of the extension assembly while FIG. 3B illustrates a right-side perspective view of the extension assembly. Referring now to both FIG. 3A and FIG. 3B, the extensions assembly 300*a*, 300*a* illustrate the U-shaped outer body 301 that is configured to snap over an upper rail of the hanger through its open elongated end. The engagement members 303*a*, 303*b*, 303*c* are shown where each of the members is configured in a substantially round, non-flat manner. Each engagement member 303*a*, 303*b*, 303*c* is partially attached to the body 301 allowing it to be moved and/or flexed while inside a respective apertures 305*a*, 305*b*, 305*c* cut into one side of the body 301. As described herein, as the extension assembly 300*a*, 300*b*, with J-hook 307, are positioned along its rail, to achieve a specific extension length, an engagement member works to frictionally engage with the hanger corner to hold the extension assembly into a fixed and/or rigid position. This in-turn allows the hanger to be adjusted to standard, extended or double extending sizes depending on the size and/or shape of the garment.

Thus, various embodiments of the invention are directed to an adjustable clothing hanger used for hanging garments and apparel that includes a flattened triangular shaped body having a first top rail, second top rail and lower rail. A first extension assembly has a plurality of first engagement members that are formed within the assembly and the first extension assembly is slidably affixed to the first top rail. A second extension assembly has a plurality of second engagement members formed therein that are slidably affixed to the second top rail. The first engagement members and second engagement members are resilient allowing them to be frictionally engaged with corners of the hanger body so to hold the first engagement assembly and second engagement assembly in a fixed position when adjusting an overall size of the clothing hanger.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. An adjustable clothing hanger used for hanging garments and apparel comprising:

a flat triangular shaped body having a first upper rail, second upper rail and a bottom rail;

a plurality of extension assemblies with one extension assembly attaching over the first upper rail and second upper rail respectively;

a plurality of J-hooks formed into each one of the plurality of extension assemblies for supporting clothing with straps; and wherein the plurality of extension assemblies each include a plurality of engagement members configured within the assembly that abut a corner of the triangular shaped body for allowing the extension assembly to be held into a fixed position when adjusting size of the hanger.

2. An adjustable clothing hanger as in claim 1, wherein each of the plurality of extension assemblies is substantially U-shaped to fit over the first upper rail and second upper rail.

3. An adjustable clothing hanger as in claim 1, where the body is formed from a cylindrical rod.

4. An adjustable clothing hanger as in claim 1, wherein a base configured under the hook allows for a plurality of hangers to be fastened atop one another.

5. An adjustable clothing hanger as in claim 1, wherein the plurality of extension assemblies each include a guide area for providing stability to the extension assembly when positioned against the first upper rail or second upper rail.

6. An adjustable clothing hanger used for hanging garments and apparel comprising:

a body formed into a flat triangular shape having a first top rail, second top rail and lower rail where a hook is configured at a top end of the body;

a first extension assembly that engages with the first upper rail;

a second extension assembly that engages with the second upper rail;

a plurality of J-hooks formed into each one of the first extension assembly and second extension assembly for supporting clothing with straps; and wherein the first extension assembly and second extension assembly each include an engagement member configured to fasten with a corner of the body, for holding the respective extension into a fixed position and enabling the overall size of the hanger to adjusted.

7. An adjustable clothing hanger as in claim 6, wherein the first extension assembly and second extension assembly are substantially U-shaped to fit over the first upper rail and second upper rail respectively.

8. An adjustable clothing hanger as in claim 6, where the body is formed from a plastic cylindrical rod.

9. An adjustable clothing hanger as in claim 6, wherein a base is configured under the hook for allowing a plurality of hangers to be joined atop one another.

10. An adjustable clothing hanger as in claim 6, wherein the first extension assembly and second extension assembly include a guide area for providing stability to the extension assembly when positioned against the first upper rail or second upper rail.

11. An adjustable clothing hanger used for hanging clothing comprising:

a flat triangular shaped body having a first top rail, second top rail and lower rail;

a first extension assembly having a plurality of first engagement members formed therein and slidably affixed to the first top rail;

a second extension assembly having a plurality of second engagement members formed therein and slidably affixed to the second top rail;

at least one J-hook formed into the first extension assembly and second extension assembly for supporting clothing with straps; and wherein one of the first engagement members and second engagement members are resilient allowing them to be frictionally engaged with corners of the body so to hold the first engagement assembly and second engagement assembly in a fixed position when adjusting an overall size of the clothing hanger.

12. An adjustable clothing hanger as in claim 11, where the body is formed from a plastic cylindrical rod.

13. An adjustable clothing hanger as in claim 11, wherein a base with a hole is configured under the hook for allowing a plurality of hangers to be joined atop one another with a fastener.

14. An adjustable clothing hanger as in claim 11, wherein the first extension assembly and second extension assembly include a guide area for providing stability to an extension assembly which moving against the first upper rail or second upper rail.

* * * * *